United States Patent [19]

Merry

[11] Patent Number: 5,024,289

[45] Date of Patent: Jun. 18, 1991

[54] INSULATED DOUBLE-WALLED EXHAUST PIPE

[75] Inventor: Richard P. Merry, White Bear Lake, Minn.

[73] Assignee: Minnesota Mining and Manufacturing Company, St. Paul, Minn.

[21] Appl. No.: 407,401

[22] Filed: Sep. 14, 1989

[51] Int. Cl.[5] ..... F01N 3/02; F01N 3/06

[52] U.S. Cl. ..... 181/231

[58] Field of Search ..... 181/231, 243, 252, 256, 181/258

[56] References Cited

U.S. PATENT DOCUMENTS

| | | | |
|---|---|---|---|
| 1,387,003 | 8/1921 | Hedges | 181/258 |
| 2,798,569 | 7/1957 | Fischer, Jr. | 181/252 |
| 3,792,136 | 2/1974 | Schmitt | 264/44 |
| 3,891,009 | 6/1975 | Noda et al. | 181/282 X |
| 4,039,480 | 8/1977 | Watson et al. | 502/9 |
| 4,657,810 | 4/1987 | Douden | 428/313.9 |

FOREIGN PATENT DOCUMENTS

0285804 A1 10/1988 European Pat. Off. .

*Primary Examiner*—Brian W. Brown

*Attorney, Agent, or Firm*—Gary L. Griswold; Walter N. Kirn; David W. Anderson

[57] ABSTRACT

A double-walled cylinder in the form of an exhaust pipe, muffler, or catalytic converter is provided less heat or sound conductive in its radial direction by filling the annular gap between the inner and outer cylinder with low-density, high-temperature resistant, inorganic spheroids.

5 Claims, 1 Drawing Sheet

INSULATED DOUBLE-WALLED EXHAUST PIPE

BACKGROUND OF THE INVENTION

The present invention relates to the exhaust system of an internal combustion engine and, more specifically, to employing low-density, high-temperature resistant, inorganic spheroids to insulate a double-walled exhaust pipe of an automobile or other motorized vehicles.

With the advent of more and more plastic and electronic components on motorized vehicles, particularly automobiles, it is becoming more important to insulate these items from the hot exhaust system. Presently, individual components or specific areas of the car are protected by heat shields or insulation, or are located a sufficient distance from the exhaust system to avoid heat. Heat shields or insulation can be costly when the item to be protected is large, such as a plastic gasoline tank, and it is not always feasible or practical to locate such items away from the exhaust system. A more economical approach is to insulate the source of the heat. In this case, the exhaust pipe which carries and is heated by the exhaust gas.

Insulating the exhaust pipe can also have other advantages. Catalytic converters must reach a certain temperature before they "light off" or begin to oxidize carbon monoxide and hydrocarbons. Insulating the exhaust pipe between the exhaust manifold and the catalytic converter minimizes heat loss and therefore decreases the time for "light off" to occur. This is very important when the car is first started, especially in cold weather, to satisfy the increasingly stringent air quality standards.

A major difficulty has been to insulate the pipe effectively, easily and economically. Ceramic fiber has been used to insulate exhaust pipes. However, since the ceramic fiber by itself is fragile and its heat insulation property is drastically reduced as it picks up moisture, it must be protected. This requires sheet metal shells to be affixed around the fiber insulation which is expensive, increases the number of parts, and can be a source of noise and rattles. In addition, the fiber may present a hazard if its escapes and becomes airborne because of metal shell breakage or corrosion during the life of the vehicle.

Double-walled exhaust pipes have been employed as a means of insulating hot exhaust gas from vehicle components. A double-walled pipe consists of a pipe within a pipe with a small annular air gap between them. Unfortunately, in many cases, it does not reduce the temperature sufficiently, and can be a source of noise, since the outer pipe is not sufficiently constrained. There have been attempts at filling this space between the two pipes with mineral powder as in European Patent Application 0 285 804 A1. Because of the dusting and caking nature of such powder, it is difficult to apply and to apply uniformly. The powder also adds significant weight to the exhaust system and must be carefully sealed against moisture absorption which has a deleterious effect on insulation properties.

It is an object of this invention to produce an economical, light-weight, low-noise, thermally-insulated, double-walled pipe system that overcomes the difficulties of previous exhaust systems. It is a further object of this invention to provide an insulated exhaust system which in the event of a catastrophic failure such as pipe breakage or corrosion would have a minimum impact on the environment.

SUMMARY OF THE INVENTION

The present invention comprises a double-walled exhaust pipe containing a uniform annular air space or gap between the outside diameter of the inner pipe and the inside diameter of the outer pipe, an annular flange is welded to each end of the pipe, and the entire annular volume between the pipes is filled with low-density, high-temperature resistant, inorganic spheres or spheroids. By high-temperature is meant at least 500° C.

Useful size range (diameter) of the above spheroids is from about 0.2 mm to about 15.0 mm. The spheroidal shape is important to ensure that the low density material readily flows into the annular gaps. Spheroids below about 0.2 mm are more difficult to handle and are more likely to dust and become airborne during the filling process. Maximum spheroid diameter is governed largely by the size of the annular gap, since the spheroid diameter must not be larger than this gap. This means for automotive applications, the spheroids must be generally smaller than 15 mm. Any size or combination of size ranges can be used without departing from the scope of this invention.

The great advantage of the spheroidal shape is the ability of the spheroids to flow freely in filling the space between pipes. This means a uniform packaging with no air gaps or spaces that would deleteriously affect the thermal and acoustical insulation properties of the pipe assembly. The spheroidal shape also allows the spheroids to slide relative to one another as the inside pipe heats up and expands relative to the outside pipe. If the internal pressure becomes too great, the spheroids can fracture to relieve pressure. Surprisingly, when these spheroids fracture, they are not reduced to powder which would allow this material to settle or compact and thus reduce its effectiveness as an insulation material. Rather, they fracture in large pieces so as to continue to occupy essentially the same volume.

The low bulk density of the spheroids, approximately 0.2–0.5 g/cc, keeps the weight of the assembly low, which is important to maintain power and minimize fuel consumption. The inert and non-fibrous nature of these spheroids produces a minimal impact on the environment should the spheroids escape due to a damaged or deteriorated pipe. The inorganic composition ensures that they will not melt or decompose when exposed to the high temperatures of an exhaust system. Because they are also impervious to water they will not absorb moisture, even if the pipe is improperly sealed.

The size of the annular gap formed in the double-walled exhaust pipe can be varied. In general, the larger the gap the greater the acoustical and heat insulation. For most exhaust systems, a gap of from 3 to 15 mm is satisfactory.

DETAILED DESCRIPTION OF THE INVENTION

Figure 1:
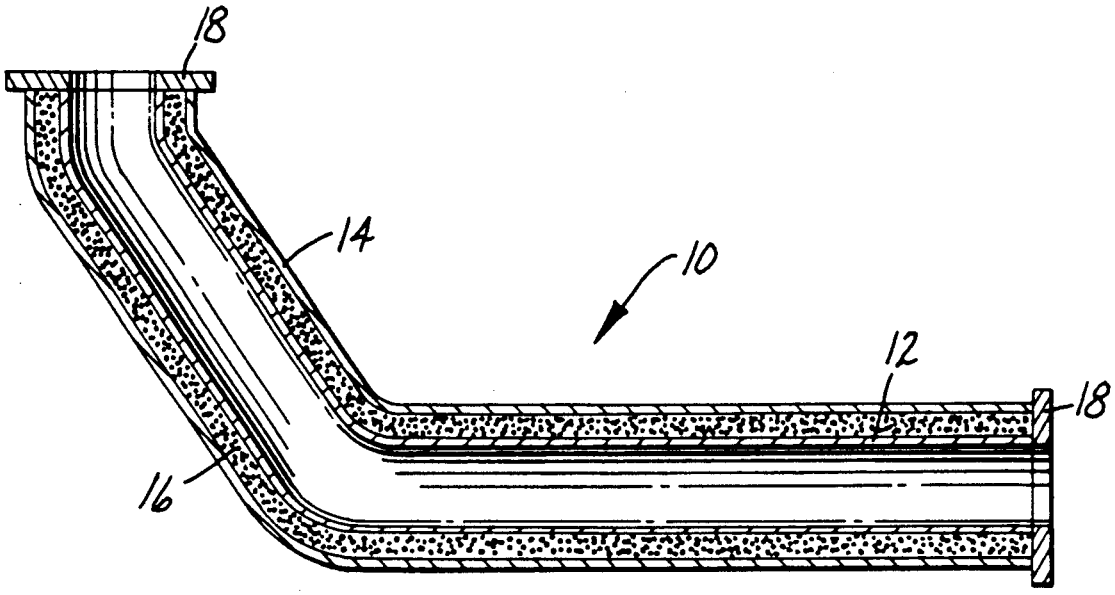
FIG. 1 is a cross-sectional view of a section of the double-walled exhaust pipe of the invention containing low-density, high-temperature resistant, inorganic spheroids.
Figure 2:
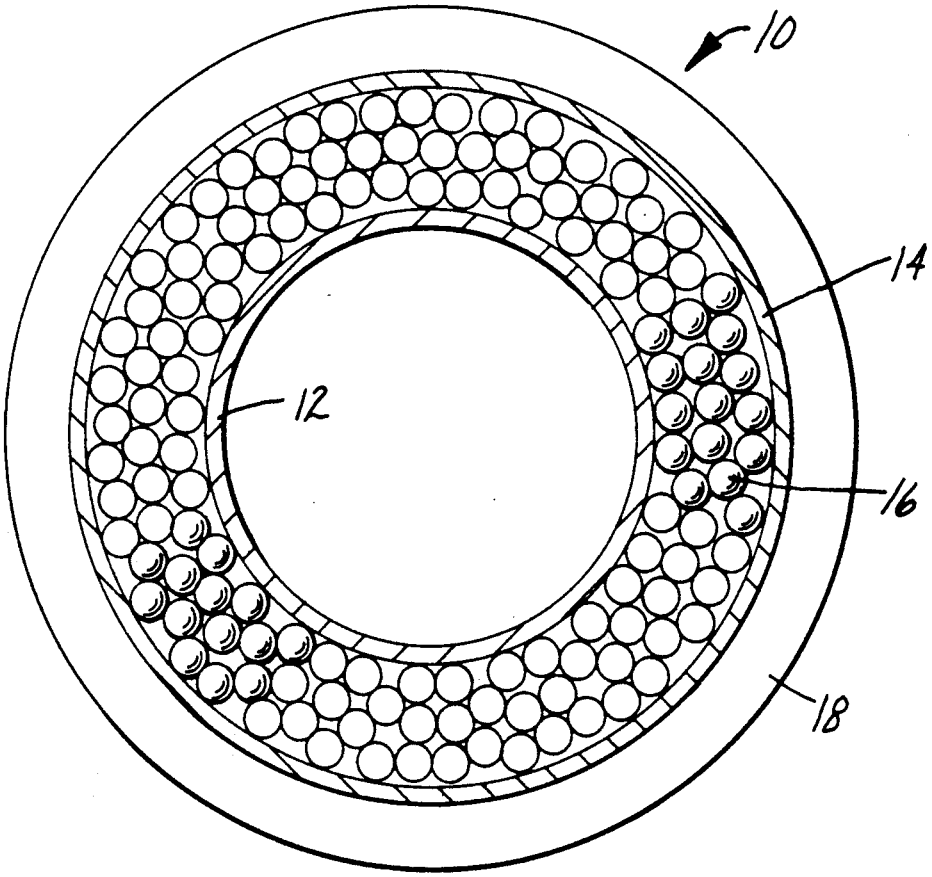
FIG. 2 is an enlarged plan view of the exhaust pipe of FIG. 1 showing the low-density, high-temperature resistant, inorganic spheroids.

Referring now to the drawing, insulated, double-walled exhaust pipe 10 comprises an inner pipe 12 of stainless steel or other heat and corrosion resistant material, an outer pipe 14 of similar construction, and, low-density, high-temperature resistant, inorganic spheroids 16 which occupy the annular gap between the two concentric pipes and the annular flanges 18 which serve to contain the low-density spheroidal insulation as well as to supply a means of attaching the pipe to an exhaust manifold, muffler, or the like.

The inner pipe 12, the outer pipe 14, and the annular flanges 18 are typically made of stainless steel. However, when exhaust temperature is lower, less expensive steel or steel alloys may be used. The annular gap occupied by the spheroids 16 can be varied. Increasing the gap decreases the heat and noise that can be transmitted to the outside pipe. For normal exhaust conditions, a gap of from 3 to 15 mm is sufficient. In the drawing the pipes are round and concentric, but could be any shape or one shape inside a pipe of a second shape without departing from the scope of this invention.

The double-walled exhaust pipe 10 can either be straight or have one or more bends in it. Depending on the wall thickness and rigidity of the pipe and the compressive strength of the spheroids used, the pipe can be bent either before or after the spheroids are inserted. If the spheroids are to be added after the pipe is bent, then the annular gap between the pipes is usually filled with sand during bending to maintain a uniform annulus. The sand is then removed and replaced with the low-density, inorganic spheroids 16.

The low-density, inorganic spheroids 16 are preferably in the 0.2–0.5 g/cc bulk density range. Individual spheroids can range from as small as 0.2 mm diameter to as large as 15 mm diameter. The larger spheroids may be used when the space between the inner and outer pipe is sufficiently large. Spheroids of 0.6–1.4 mm diameter in a gap of 3 to 10 mm are preferred for normal automobiles exhaust pipes.

The preferred composition of the spheroids is sodium silicate and clay, as described in U.S. Pat. No. 4,657,810 which is assigned to the present assignee and is incorporated herein by reference. These spheroids are low cost, impermeable to water, and are thermally stable to 1100° C. They are commercially available from 3M Company under the tradename Macrolite Ceramic Spheres. Other suitable materials may include hollow glass spheres, alumina-silica spheres, or other low density, inorganic spheres as described in U.S. Pat. No. 4,039,480 or low density, metal oxide spheres such as zirconium oxide, magnesium oxide, calcium oxide, aluminum oxide, and silicon oxide, as described in U.S. Pat. No. 3,792,136. If the exhaust gas temperature is sufficiently low, hollow glass spheres can also be used.

The above Macrolite ceramic spheroids 16 comprise:

A. a continuous phase made of a material selected from the group consisting of aluminum phosphate ($AlPO_4$), sodium silicate ($Na_2Ox_1SiO_2$) and potassium silicate ($K_2Ox_2SiO_2$); and B. an insolubilizing agent, which combines with the continuous phase during firing to make the continuous phase insoluble in water; said fired, hollow spheroids having a cellular shell.

$x_1$ is the molar ratio of silica ($SiO_2$) to soda ($Na_2O$) and $X_2$ is the molar ratio of silica to potassium oxide ($K_2O$).

The spheroids are typically in the range of about 0.2 to 15 mm diameter with bulk densities of about 0.2 to 0.5 g/cc, and are stable to at least 600° C. The shell of the spheroids is cellular, and it can be made from inexpensive raw materials such as sodium silicate (continuous phase) and clay (insolubilizing agent).

Typically, the spheroids are made by mixing sodium silicate with clay (e.g., hydrated Kaolinite) to form a pliable, plastic mass or paste. This mass is formed into pellets ranging from about 2 to 10 mm in size. These pellets are expanded to from 1.5 to 2.0 times their original size by heating (e.g. 150°–200° C.), often in the presence of a parting agent. The expanded pellets which have now taken on a spheroidal shape are further heated or fired to 400° C. in a furnace during which the clay reacts with the sodium silicate to make it insoluble in water. Other insolubilizing agents which can be used instead of clay are: iron oxide, titanium dioxide, alumina trihydrate ($Al_2O_3.3H_2O$) and zinc oxide. Spheroids made with these compounds should be fired at temperatures of at least 600° C. generally in the range of 600° to 1000° C.

In the above-described process, typical composition ranges are:

weight percent water in the paste: 35–45% weight ratio of $SiO_2$:$Na_2O$: 2.75–3.65 weight ratio of silicate solids to clay: 0.8–3

The effect of the latter two variables on product density is as follows:

as $SiO_2$:$Na_2O$ ratio increases, density increases; and as the ratio of silicate solids to clay increases, density decreases For potassium silicates, the ratio $x_2$ is typically in the range 2.5–4.

To demonstrate the utility of this invention the following examples were prepared.

COMPARATIVE EXAMPLE AND EXAMPLES 1–3

A 30.5 cm section of a double-walled exhaust pipe was formed using an inner stainless steel pipe having an outer diameter of 4.76 cm and an outer stainless steel pipe having an inside diameter of 6.03 cm, resulting in an annular gap between them of about 6.35 mm. The wall thickness of each pipe was about 1.6 mm. The pipes were welded on one end to a connecting annular flange. Thermocouples were attached to the outside of both the inner and outer pipe spaced 180° apart (four thermocouples total) at midlength of the pipe to record the temperature of each pipe. The double-walled pipe was then connected to a natural gas burner which had a temperature controller that could control the temperature of the gas entering the inner pipe.

The double-walled pipe was first tested (comparative Example) with the annular gap empty. The outlet end of the annular gap was sealed with a small ring of ceramic fiber to simulate minimal natural convection conditions. The inlet gas temperature was controlled at 950° C. Flow rate was approximately 5 $m^3$/min. The pipe temperatures were allowed to stabilize for ½ hour before they were recorded. After recording temperatures for the empty annular gap, the annular gap was filled (Example 1) with Macrolite ceramic spheres, sphere type ML 357, available commercially from 3M Company. The outlet end of the annular gap was again sealed with ceramic fiber and the same flow rate and inlet gas temperature was used. The pipe temperatures were again allowed to stabilize for ½ hour before recording. This procedure was followed two more times with sphere type ML 714 (Example 2) and sphere type ML 1430 (Example 3) Macrolite ceramic spheres, respectively. Temperature results are shown in Table I below:

TABLE I

Heat-Insulation Properties of Double-Walled Exhaust Pipe

| Example | Material In Annular Gap | Sphere Diameter | Average Temp. Inner Pipe | Average Temp. Outer Pipe |
|---|---|---|---|---|
| Comparative | None | — | 727° C. | 475° C. |
| 1 | ML 357 | 5.7–2.8 mm | 786° C. | 416° C. |
| 2 | ML 714 | 2.8–1.4 mm | 794° C. | 403° C. |
| 3 | ML 1430 | 1.4–0.6 mm | 792° C. | 390° C. |

As can be determined by analyzing the data obtained for the examples of this invention in Table I, the heat insulation provided by the low-density, inorganic spheroids lowers the temperature of the outer pipe by as much as 85° C. while maintaining a higher inner pipe temperature by as much as 65° C. Thus, not only is the outer pipe cooler to protect vehicle parts from heat, but a higher gas temperature can be delivered to a catalytic converter for quicker "light off".

The durability of the double-walled exhaust pipe was then tested by welding a cap on the pipe containing the Macrolite ML 1430 ceramic spheres and shaking it at an acceleration of 10 Gs and a frequency of 100 Hz with an inlet gas temperature at 950° C. for two hours. The vibrations were supplied by an electromechanical vibrator made by Unholtz-Dickie Corp. After testing, pipe cap was removed. There was no evidence of volume reduction. The spheres were then poured out of the gap and examined. There was no sign of any of the spheres breaking down to powder.

The invention has been described using low-density, high-temperature resistant, inorganic spheres to insulate a double-walled pipe, but alternatively they could also be used to help reduce heat and noise from a muffler or catalytic converter by utilizing a similarly filled double-walled gap surrounding the outside of these items. Likewise, multiple gaps could be provided by using additional walls.

Other embodiments of this invention will be apparent to those skilled in the art from a consideration of this specification or practice of the invention disclosed herein. Various omissions, modifications and changes to the principles described may be made by one skilled in the art without departing from the true scope and spirit of the invention which is indicated by the following claims.

I claim:

1. An improved double-walled exhaust pipe including an inner pipe, an outer pipe surrounding the inner pipe to produce a uniform annular gap therebetween, and an annular flange attached to each end of the inner and outer pipes, wherein the improvement comprises:

filling the annular gap between the inner pipe, the outer pipe and the annular flanges with low-density, high-temperature resistant, inorganic, fired, hollow, ceramic spheroids comprising A. a continuous phase made of a material selected from the group consisting of aluminum phosphate, sodium silicate ($Na_2Ox_1SiO_2$) in which $x_1$ is the molar ratio of $SiO_2$ to $Na_2O$ and is between about 2.75 and 3.65 and potassium silicate ($K_2Ox_2SiO_2$) in which $x_2$ is the molar ratio of $SiO_2$ to $K_2O$ and is between about 2.5 and 4; and B. an insolubilizing agent, selected from the group consisting of kaolin clay, iron oxide, titanium dioxide, alumina trihydrate an zinc oxide, which combines with the continuous phase during firing to make the continuous phase insoluble in water;

said hollow, ceramic spheroids having a cellular shell, in which the shell material contains a multiplicity of irregular, non-spherical, hollow cells.

2. An improved double-walled exhaust pipe according to claim 1 wherein the inner pipe is selected from stainless steel, steel, or steel alloys.

3. An improved double-walled exhaust pipe according to claim 1 wherein the outer pipe is selected from stainless steel, steel, or steel alloys.

4. The fired, hollow spheroids of claim 1 which range in diameter from 0.2 mm to 15 mm and preferably range in diameter from 0.6 mm to 1.4 mm.

5. The fired, hollow spheroids of claim 1 which have a bulk density ranging from 0.2 g/cc to 0.5 g/cc.

* * * * *